US008375666B2

(12) United States Patent
Stahl, Jr. et al.

(10) Patent No.: US 8,375,666 B2
(45) Date of Patent: Feb. 19, 2013

(54) FIRESTOPPING SEALING MEANS FOR USE WITH GYPSUM WALLBOARD IN HEAD-OF-WALL CONSTRUCTION

(75) Inventors: James P. Stahl, Jr., Princeton Junction, NJ (US); James P. Stahl, Sr., Stockton, NJ (US); Julio Lopes, Dunellen, NJ (US)

(73) Assignee: Specified Technologies Inc., Somerville, NJ (US)

( * ) Notice: Subject to any disclaimer, the term of this patent is extended or adjusted under 35 U.S.C. 154(b) by 21 days.

(21) Appl. No.: 12/803,667

(22) Filed: Jul. 1, 2010

(65) Prior Publication Data

US 2011/0011019 A1 Jan. 20, 2011

Related U.S. Application Data

(60) Provisional application No. 61/270,839, filed on Jul. 14, 2009, provisional application No. 61/277,335, filed on Sep. 23, 2009.

(51) Int. Cl.
*E04B 1/94* (2006.01)

(52) U.S. Cl. ..... 52/317; 52/232; 52/287.1; 52/394; 52/396.01

(58) Field of Classification Search ..... 52/317, 52/232, 396.01, 394, 241, 242, 287.1
See application file for complete search history.

(56) References Cited

U.S. PATENT DOCUMENTS

| | | | | |
|---|---|---|---|---|
| 2,109,655 | A | | 3/1938 | Sylvan |
| 2,111,634 | A | | 3/1938 | Kotrbaty |
| 2,180,317 | A | | 11/1939 | Davis |
| 2,252,578 | A | | 8/1941 | Powell |
| 2,717,062 | A | | 9/1955 | Dusing et al. |
| 2,915,150 | A | | 12/1959 | Weidler |
| 2,971,616 | A | | 2/1961 | Bayley, Jr. |
| 3,062,338 | A | | 11/1962 | Ridder et al. |
| 3,170,269 | A | | 2/1965 | Dunnington |
| 3,197,119 | A | | 7/1965 | Hartig et al. |
| 3,217,453 | A | | 11/1965 | Medow |
| 3,231,644 | A | | 1/1966 | Chang |
| 3,264,165 | A | * | 8/1966 | Stickel ..... 428/69 |
| 3,273,297 | A | | 9/1966 | Wehe, Jr. |
| 3,315,429 | A | | 4/1967 | Swanson |
| 3,357,146 | A | | 12/1967 | Gartrell |
| 3,501,868 | A | | 3/1970 | Ganzinotti |
| 3,508,368 | A | | 4/1970 | Tischuk et al. |
| 3,601,942 | A | | 8/1971 | Wilson |
| 3,786,604 | A | * | 1/1974 | Kramer ..... 52/232 |
| 3,805,471 | A | | 4/1974 | De Schutter |
| 3,854,253 | A | | 12/1974 | Slowbe |
| 4,155,208 | A | | 5/1979 | Shanabarger |
| 4,182,085 | A | | 1/1980 | Elson |

(Continued)

FOREIGN PATENT DOCUMENTS

GB 2261892 A * 6/1993

*Primary Examiner* — Brian Glessner
*Assistant Examiner* — Adriana Figueroa
(74) *Attorney, Agent, or Firm* — Sperry, Zoda & Kane

(57) ABSTRACT

A sealing gasket for use attached to the topmost edge of gypsum board used as construction wallboard. The gasket includes a support leg section capable of being mounted in engagement with the uppermost edge of the gypsum board. The gasket includes a sealing leg extending outwardly from said leg section which includes an intumescent component to facilitate sealing between the edge of the gypsum board and the wall structure above. The sealing leg preferably includes an intumescent impregnated paper material covered with a structurally enhancing layer. An adhesive layer can be included to attach the gasket to the gypsum wallboard. The sealing leg is preferably planar and extends upwardly and inwardly over the upper edge of the gypsum board at an obtuse angle with respect to the support leg for sealing the head-of-wall area thereabove.

12 Claims, 3 Drawing Sheets

U.S. PATENT DOCUMENTS 4,364,212 A 12/1982 Pearson et al.
4,399,645 A 8/1983 Murphy et al.
4,405,076 A * 9/1983 Lines et al. ..... 220/560.01
4,424,867 A 1/1984 Mallow
4,449,341 A 5/1984 Taglianetti et al.
4,531,332 A 7/1985 Gartner
4,733,514 A 3/1988 Kelly
4,866,898 A 9/1989 LaRoche et al.
4,869,037 A 9/1989 Murphy
4,884,381 A 12/1989 Betti
5,088,249 A 2/1992 Marzouki
5,127,203 A 7/1992 Paquette
5,127,425 A 7/1992 Cornwall
5,127,760 A 7/1992 Brady
5,129,201 A 7/1992 Robertson et al.
5,155,957 A 10/1992 Robertson et al.
5,183,070 A 2/1993 Cornwall
5,187,910 A * 2/1993 Nicholas et al. ..... 52/317
5,293,724 A 3/1994 Cornwall
5,390,465 A 2/1995 Rajecki
5,417,019 A 5/1995 Marshall et al.
5,471,805 A 12/1995 Becker
5,498,466 A 3/1996 Navarro et al.
5,624,726 A * 4/1997 Sanocki et al. ..... 428/74
5,655,350 A 8/1997 Patton
5,744,199 A 4/1998 Joffre et al.
5,765,332 A 6/1998 Landin et al.
5,887,395 A 3/1999 Navarro et al.
5,921,041 A 7/1999 Egri, II
6,058,668 A 5/2000 Herren
6,112,488 A * 9/2000 Olson et al. ..... 52/393
6,125,608 A 10/2000 Charlson
6,128,874 A * 10/2000 Olson et al. ..... 52/232
6,131,352 A 10/2000 Barnes et al.
6,176,053 B1 1/2001 Germain
6,189,277 B1 2/2001 Boscamp
6,418,689 B1 7/2002 Hacquard et al.
6,698,146 B2 3/2004 Morgan et al.
6,783,345 B2 8/2004 Morgan et al.
7,043,880 B2 * 5/2006 Morgan et al. ..... 52/2.23
7,152,385 B2 12/2006 Morgan et al.
7,240,905 B1 * 7/2007 Stahl, Sr. ..... 277/652
7,424,793 B1 9/2008 Shriver
7,435,369 B2 10/2008 Hennis et al.
7,856,781 B2 * 12/2010 Hilburn, Jr. ..... 52/394
2002/0056242 A1 5/2002 Andresen
2003/0099833 A1 * 5/2003 Erb et al. ..... 428/404
2006/0032163 A1 * 2/2006 Korn ..... 52/241
2006/0137293 A1 * 6/2006 Klein ..... 52/782.1
2007/0175140 A1 8/2007 Giannos
2008/0172960 A1 * 7/2008 Hilburn ..... 52/232

* cited by examiner

FIRESTOPPING SEALING MEANS FOR USE WITH GYPSUM WALLBOARD IN HEAD-OF-WALL CONSTRUCTION

The present utility application hereby formally claims priority of currently pending U.S. Provisional Patent application No. 61/270,839 filed Jul. 14, 2009 on "SEALING MEANS FOR GYPSUM WALLBOARD" filed by the inventor's, James P. Stahl Sr. and James P. Stahl Jr., and assigned to SPECIFIED TECHNOLOGIES INC. of Somerville, N.J., said referenced provisional application being hereby formally incorporated by reference as an integral part of the present application.

The present utility application also hereby formally claims priority of currently pending U.S. Provisional Patent application No. 61/277,335 filed Sep. 23, 2009 on "PLANAR SEALING MEANS FOR GYPSUM WALLBOARD" filed by James P. Stahl Jr. and Julio Lopes and assigned to SPECIFIED TECHNOLOGIES INC. of Somerville, N.J., said referenced provisional application being hereby formally incorporated by reference as an integral part of the present application.

BACKGROUND OF THE INVENTION

1. Field of the Invention

The present invention deals with the field of firestop sealing devices positionable between the upper edge of the gypsum wallboard and the lower edge of a floor located thereabove commonly defined as the head-of-wall area of building construction. Many of these floor configurations can have various shapes and designs and a need exists for a means of sealing this area in the event of a fire to prevent passage of unwanted flames, heat and gases therebetween. The present invention is particularly useful when attached with respect to any of the commonly available top of wall constructions. The flexibly resilient intumescent gasket of the present design is very useful for the purpose of replacing the common current practice of utilizing filler materials such as caulk or firestopping mastic materials in the otherwise opened head-of-wall joint areas beneath floor and above the gypsum wallboard therebelow. Use of such materials is labor intensive and the quality of the final fire seal is greatly dependent on the skill level of the on-site worker.

2. Description of the Prior Art

Many patents have been granted for various constructions for the purpose of sealing the opened head-of-wall joint areas between gypsum wallboard and the lower surface of a floor or ceiling construction located immediately thereabove such as shown in U.S. Pat. No. 2,109,655 patented Mar. 1, 1938 to J. Sylvan on a "Building Construction"; and U.S. Pat. No. 2,111,634 patented Mar. 22, 1938 to G. F. Kotrbaty and assigned to Ferrocon Corporation on a "Building Structure And Joint Therefor"; and U.S. Pat. No. 2,180,317 patented Nov. 14, 1939 to C. F. Davis and assigned to American Cyanamid & Chemical Corporation on a "Metal Decking"; and U.S. Pat. No. 2,291,616 patented Aug. 4, 1942 to J. Fletcher and assigned to The Plastergon Wall Board Company on a "Method Of Coating Webs"; and U.S. Pat. No. 2,616,866 to W. Juda and assigned to Pyrotron Development Corporation on a "Fire Retardant"; and U.S. Pat. No. 2,717,062 patented Sep. 6, 1955 to L. F. Dusing et al and assigned to Dusing & Hunt, Inc. F. H. Saino Manufacturing Company on a "Fire Door"; and U.S. Pat. No. 2,915,150 patented Dec. 1, 1959 to R. W. Weidler on a "Basement Assembly And Prefabricated Structural Units Therefor"; and U.S. Pat. No. 2,926,928 patented Mar. 1, 1960 to W. Bennett and assigned to Utility Trailer Manufacturing Company on a "Unitary Floor And Frame Structure For Vehicles"; and U.S. Pat. No. 3,062,338 patented Nov. 6, 1962 to E. J. De Ridder et al and assigned to Reynolds Metals Company on "Double Faced Panels"; and U.S. Pat. No. 3,151,663 patented Oct. 6, 1964 to W. A. Bohner et al and assigned to General Motors Corporation on an "Inflatable Closure Apparatus"; and U.S. Pat. No. 3,170,269 patented Feb. 23, 1965 to J. B. Dunnington and assigned to Butler Manufacturing Company on a "Base Channel Panel Footing Structure"; and U.S. Pat. No. 3,217,453 patented Nov. 16, 1965 to R. S. Medow and assigned to Leonard I. Vogel on a "Facing Structure And Article"; and U.S. Pat. No. 3,231,644 patented Jan. 25, 1966 to M. Y. Chang on a "Method And Apparatus For Building Construction"; and U.S. Pat. No. 3,269,072 patented Aug. 30, 1966 to J. J. Black and assigned to Pullman Incorporated on a "Vehicle Floor Construction"; and U.S. Pat. No. 3,273,297 patented Sep. 20, 1966 to H. W. Wehe, Jr. and assigned to Overly Manufacturing Company on a "Door And Panel Construction"; and U.S. Pat. No. 3,315,429 patented Apr. 25, 1967 to W. D. Swanson and assigned to National Steel Corporation on a "Wall Construction And Element"; and U.S. Pat. No. 3,328,926 patented Jul. 4, 1967 to K. Reinhard and assigned to Ador Corporation on an "Inflatable Housing Construction"; and U.S. Pat. No. 3,343,324 patented Sep. 26, 1967 to W. Gordon and assigned to William Gordon and Eve Gordon on an "Underwater Structural Unit"; and U.S. Pat. No. 3,357,142 patented Dec. 12, 1967 to J. F. Furrer et al and assigned to the United States of America as represented by the Secretary of the Army on a "Foam Plastic Shelter"; and U.S. Pat. No. 3,357,146 patented Dec. 12, 1967 to J. T. Gartrell and assigned to Birdsboro Corporation on a "Building Panel Splicing"; and U.S. Pat. No. 3,414,320 patented Dec. 3, 1968 to G. Heim and assigned to Daimler-Benz Aktiengesellschaft on a "Sliding Roof, Especially for Motor Vehicles"; and U.S. Pat. No. 3,501,868 patented Mar. 24, 1970 to J. V. Ganzinotti and assigned to Equipment Moderne Industriel par Application du Caoutchonc Manufacture et des Plastiques EMI on "Sealing Joints"; and U.S. Pat. No. 3,508,368 patented Apr. 28, 1970 to W. Tischuk et al and assigned to H. H. Robertson Company on a "Building Panel Having Tapered Counter-Sunk End Portion And Method Of Erecting The Same"; and U.S. Pat. No. 3,601,942 patented Aug. 31, 1971 to J. D. Wilson on a "Building Wall Construction"; and U.S. Pat. No. 3,631,644 patented Jan. 4, 1972 to L. Mazza and assigned to Industrie A. Zanussi S.p.A. on a "Sectional Frame For Refrigerators"; and U.S. Pat. No. 3,786,604 patented Jan. 22, 1974 to F. Kramer and assigned to U.F. Chemical Corp. on a "Fire Stop Between Floor Slab And Curtain Wall Of Building"; and U.S. Pat. No. 3,854,253 patented Dec. 17, 1974 to J. A. Slowbe on a "Joint Construction Between Supported And Supporting Members"; and U.S. Pat. No. 4,044,510 patented Aug. 30, 1977 to L. O'Neal on a "Venting Valve For Inflatable Dock Seals"; and U.S. Pat. No. 4,045,925 patented Sep. 6, 1977 to L. O'Neal on an "Inflatable Dock Seal And Mounting Therefor"; and U.S. Pat. No. 4,155,208 patented May 22, 1979 to J. A. Shanabarger on "Building Insulation And Method Of Installation"; and U.S. Pat. No. 4,188,756 patented Feb. 19, 1980 to S. O. B. Ljungbo and assigned to Erecta AG on a "Heat-Insulated Plastic Hall"; and U.S. Pat. No. 4,267,609 patented May 19, 1981 to G. Altman et al and assigned to Thermasol Ltd. on a "Gasket Assembly For Coupling Drainage Outlet Openings In Bathtub Liner Installations"; and U.S. Pat. No. 4,399,645 patented Aug. 23, 1983 to P. D. Murphy et al and assigned to Lou Weitz, Jeriline Ward and Joy Murphy on a "Bladder Insulation"; and U.S. Pat. No. 4,449,341 patented May 22, 1984 to P. C. Tagianetti et al and assigned to PPG Industries, Inc. on a "Fire Containment Arrangement For Curtain Wall Construction"; and U.S. Pat. No. 4,455,802 patented Jun. 26, 1984 to J. Charniga on "Wire Screen Fire Stops"; and U.S. Pat. No. 4,531,332 patented Jul. 30, 1985 to K. Gartner and assigned to Yoshid Kogyo K. K. on a "Rooftop Parapet For Thermally-Insulated Curtain Wall"; and U.S. Pat. No. 4,676,032 patented Jun. 30, 1987 to P. Jutras on an "Inflatable Wall Structure"; and U.S. Pat. No. 4,679,373 patented Jul. 14, 1987 to B. Ludwig on a "Method And Device For The Aligning Of An Element, E.G. Frame, To Be Inserted Into A Wall Opening"; and U.S. Pat. No. 4,733,514 patented Mar. 29, 1988 to T. L. Kelly on a "Building Construction With Meltable Insulation And Reservoir Trough Therefor"; and U.S. Pat. No. 4,866,898 patented Sep. 19, 1989 to A. R. LaRoche et al and assigned to Manville Corporation on a "Fire Resistant Expansion Joint"; and U.S. Pat. No. 4,869,037 patented Sep. 26, 1989 to J. J. Murphy on a "Wall Construction"; and U.S. Pat. No. 4,918,897 patented Apr. 24, 1990 to C. W. Luedtke on a "Construction System For Detection Structures And Multiple Story Buildings"; and U.S. Pat. No. 5,048,257 patented Sep. 17, 1991 to C. W. Luedtke on a "Construction System For Detection Structures And Multiple Story Buildings"; and U.S. Pat. No. 5,088,249 patented Feb. 18, 1992 to T. Marzouki and assigned to Roland-Werke Dachbaustoffe and Bauschemie GmbH & Co. KG on a "Roof Covering Or Wall Covering"; and U.S. Pat. No. 5,187,910 patented to J. D. Nicholas et al on Feb. 23, 1993 and assigned to MM Systems Corporation on a "Fire Barrier System"; and U.S. Pat. No. 5,293,724 patented Mar. 15, 1994 to K. Cornwall on a "Coupling Assembly For Corrugated Decks And Method For Connecting Thereto"; and U.S. Pat. No. 5,417,019 patented May 23, 1995 to D. P. Marshall et al and assigned to Lamson & Sessions Co. on a "Passthrough Device With Firestop"; and U.S. Pat. No. 5,655,350 patented Aug. 12, 1997 to B. L. Patton on a "Method For Retro-Fit Forming Firestops In Existing Wall Structures With Blown Insulation"; and U.S. Pat. No. 5,765,332 patented Jun. 16, 1998 to H. V. Landin et al and assigned to Minnesota Mining And Manufacturing Company on a "Fire Barrier Protected Dynamic Joint"; and U.S. Pat. No. 6,058,668 patented May 9, 2000 to T. R. Herren on a "Seismic And Fire-Resistant Head-Of-Wall Structure"; and U.S. Pat. No. 6,125,608 patented Oct. 3, 2000 to J. A. Charlson and assigned to United States Building Technology, Inc. on "Composite Insulated Framing Members And Envelope Extension System For Buildings"; and U.S. Pat. No. 6,131,352 patented Oct. 17, 2000 to V. Barnes et al on a "Fire Barrier"; and U.S. Pat. No. 6,418,689 patented Jul. 16, 2002 to P. Hacquard and assigned to Someta on a "Removable Wall System"; and U.S. Pat. No. 6,698,146 patented Mar. 2, 2004 to M. D. Morgan et al and assigned to W. R. Grace & Co.-Conn. on "In Situ Molded Thermal Barriers"; and U.S. Pat. No. 6,783,345 patented Aug. 31, 2004 to M. D. Morgan et al and assigned to W. R. Grace & Co.-Conn. on "In Situ Molded Thermal Barriers"; and U.S. Pat. No. 7,043,880 patented May 16, 2006 to M. D. Morgan and assigned to W. R. Grace & Co.-Conn. on "In Situ Molded Thermal Barriers"; and U.S. Pat. No. 7,152,385 patented Dec. 26, 2006 to M. D. Morgan et al and assigned to W. R. Grace & Co.-Conn. on "In Situ Molded Thermal Barriers"; and U.S. Pat. No. 7,424,793 patented Sep. 16, 2008 to J. C. Shriver and assigned to Thermafiber, Inc. on an "Interlocking Curtain Wall Insulation System"; and U.S. Pat. No. 7,435,369 patented Oct. 14, 2008 to M. E. Hennis et al and assigned to BPH plc on a "Method For Targeted Delivery Of Additives To Varying Layers In Gypsum Panels"; and U.S. Pat. No. 2,252,578 patented Aug. 12, 1941 to H. D. Powell on "Insulation Of Buildings"; and U.S. Pat. No. 2,307,902 patented Jan. 12, 1943 to C. W. Vogt et al on a "Container"; and U.S. Pat. No. 2,971,616 patented to E. D. Bayley, Jr. on Feb. 14, 1961 on a "Building Panel"; and U.S. Pat. No. 3,108,404 patented Oct. 29, 1963 to L. N. Lamb on an "Anchor Device For Hollow Masonry Type Walls"; and U.S. Pat. No. 3,264,165 patented Aug. 2, 1966 to C. A. Stickel on an "Insulating Means"; and U.S. Pat. No. 3,297,233 patented Jan. 10, 1967 to C. E. Meyerhoefer on a "Vacuum Cleaner Bag With Closed Tube"; and U.S. Pat. No. 3,370,780 patented Feb. 27, 1968 to F. B. Shaw on a "Bag With Self-Venting Back Seam"; and U.S. Pat. No. 3,430,842 patented Mar. 4, 1969 to G. Yamaguchi on a "Valved Bag"; and U.S. Pat. No. 3,751,881 patented Aug. 14, 1973 to G. L. Hughes and assigned to Aktiebolaget Electrolux on a "Dust Receptacle For A Vacuum Cleaner"; and U.S. Pat. No. 3,805,471 patented Apr. 23, 1974 to C. R. De Schutter and assigned to Perfect Module Systems, Inc. on a "Building Panel Construction System"; and U.S. Pat. No. 3,859,064 patented Jan. 7, 1975 to M. Cordell and assigned to Studley paper Company, Inc. on a "Double-Wall Vacuum Cleaner Filter Bag"; and U.S. Pat. No. 3,894,682 patented Jul. 15, 1975 to A. C. Harmsen and assigned to Gilman Paper Company on a "Container With Filling Opening And Closure Means Therefor"; and U.S. Pat. No. 3,918,512 patented Nov. 11, 1975 to D. W. Kuneman on a "Window Arrangement"; and U.S. Pat. No. 4,136,208 patented Jan. 23, 1979 to K. K. Light et al and assigned to International Flavors & Fragrances Inc. on a "Flavoring With Substituted Norbornane Derivatives"; and U.S. Pat. No. 4,172,345 patented Oct. 30, 1979 to R. U. Alderman and assigned to Butler Manufacturing Company on "Insulation Bags"; and U.S. Pat. No. 4,172,915 patented Oct. 30, 1979 to N. Sheptak et al and assigned to American Can Company on "Thermal Insulation"; and U.S. Pat. No. 4,182,085 patented Jan. 8, 1980 to J. M. Elson on a "Method And Structure For Insulating A Wall Or Ceiling"; and U.S. Pat. No. 4,269,890 patented May 26, 1981 to R. Breitling et at and assigned to Daimler-Benz Akktiengesellschaft on a "Process And Apparatus For Introducing Foam Into Automobile Body Cavities"; and U.S. Pat. No. 4,312,279 patented to J. C. Wilson et al on Jan. 26, 1982 on a "Compactor-Feeder For Solid Waste Incinerator"; and U.S. Pat. No. 4,364,212 patented Dec. 21, 1982 to R. J. Pearson et al and assigned to National Gypsum Company on a "Fire-Resistant Metal Stud"; and U.S. Pat. No. 4,424,867 patented Jan. 10, 1984 to W. A. Mallow and assigned to Fiberglas Canada Inc. on a "Heat Hardening Sealant-Gel For Flexible Couplings"; and U.S. Pat. No. 4,445,898 patented May 1, 1984 to M. E. Jensen and assigned to Hollister Incorporated on a "Fecal Inkcontinence Device With Separable Release Sheets"; and U.S. Pat. No. 4,566,131 patented Jan. 21, 1986 to F. Achelpohl and assigned to Windmoller & Holscher on a "Valved Bag"; and U.S. Pat. No. 4,583,565 patented Apr. 22, 1986 to K. Cornwall on a "Firestop Stack Fitting And Coupling Combination; and U.S. Pat. No. 4,638,829 patented Jan. 27, 1987 to K. Cornwall on a "Firestop Fitting For Carrier Mounted Water Closets; and U.S. Pat. No. 4,658,434 patented Apr. 14, 1987 to E. Murray and assigned to Grain Security Foundation Ltd. on "Laminates And Laminated Articles", and U.S. Pat. No. 4,724,858 patented Feb. 16, 1988 to K. Cornwall on a "Firestop Stack Fitting"; and U.S. Pat. No. 4,726,974 patented Feb. 23, 1988 to J. Nowobilski et al and assigned to Union Carbide Corporation on a "Vacuum Insulation Panel"; and U.S. Pat. No. 4,850,385 patented Jul. 25, 1989 to G. Harbeke on a "Fire Stop Pipe Coupling Adaptor"; and U.S. Pat. No. 4,871,477 patented Oct. 3, 1989 to F. Dimanshteyn and assigned to Firestop Chemical Corporation on "Fire Protected Foamed Polymeric Materials"; and U.S. Pat. No. 4,878,481 patented Nov. 7, 1989 to T. Schoeff et al and assigned to Majco Building Specialities, L.P. on a "Fireplace Having Chimney Construction Including Cold Air Barrier"; and U.S. Pat. No. 4,884,381 patented Dec. 5, 1989 to P. Betti and assigned to Jorge Gabrielli Zacharias Calixto on a "Structural Joint System"; and U.S. Pat. No. 4,942,050 patented Jul. 17, 1990 to J. Ylvisaker on a "Process For Forming A Microwave Popcorn Package" and U.S. Pat. No. 4,988,406 patented Jan. 29, 1991 to T. Nelson and assigned to Soltech, Inc. on an "Insulation Device and Method Of Making Same"; and U.S. Pat. No. 5,035,951 patented Jul. 30, 1991 to F. Dimanshteyn and assigned to Firestop Chemical Corporation on "Fire Resistant Coatings"; and U.S. Pat. No. 5,076,309 patented Dec. 31, 1991 to K. Cornwall on a "Firestop Stub-Out Assembly"; and U.S. Pat. No. 5,127,203 patented Jul. 7, 1992 to R. Paquette on a "Seismic/Fire Resistant Wall Structure and Method"; and U.S. Pat. No. 5,127,425 patented Jul. 7, 1992 to K. Cornwall on a "Horizontal Firestop Fitting"; and U.S. Pat. No. 5,127,760 patented Jul. 7, 1992 to T. Brady on a "Vertically Slotted Header"; and U.S. Pat. No. 5,129,201 patented Jul. 14, 1992 to E. Robertson et al and assigned to National Improvement Company on a "Fire Safety Device"; and U.S. Pat. No. 5,155,957 patented Oct. 20, 1992 to E. Robertson et al and assigned to National Improvement Company on a "Fire Safety Device"; and U.S. Pat. No. 5,180,063 patented Jan. 19, 1993 to M. Sakno and assigned to Instant Firestop Inc. on a "Fire-Stop Sealant Kit"; and U.S. Pat. No. 5,183,080 patented Feb. 2, 1993 to K. Cornwall on a "Firestop Device For Flammable Floor Construction"; and U.S. Pat. No. 5,340,612 patented Aug. 23, 1994 to R. Perito and assigned to W.R. Grace & Co.-Conn. on "Sprayable Portland Cement-Based Fireproofing Compositions"; and U.S. Pat. No. 5,356,446 patented Oct. 18, 1994 to D. Smetana et al on "Low Density Insulating And Fire-Resistant Perlite Concrete"; and U.S. Pat. No. 5,384,188 patented Jan. 24, 1995 to A. Lebold et al and assigned to The Carborundum Company on an "Intumescent Sheet"; and U.S. Pat. No. 5,390,465 patented Feb. 21, 1995 to J. Rajecki and assigned to The Lamson & Sessions Co. on a "Passthrough Device With Firestop"; and U.S. Pat. No. 5,391,347 patented Feb. 21, 1995 to B. Bastide et al on a "Process For The Production Of Sintered Nuclear Fuel Pellets Form Precipitated Solutions With The Aid Of Hydrogen Peroxide In An Acid Medium"; and U.S. Pat. No. 5,392,558 patented Feb. 28, 1995 to E. Blomquist and assigned to Farnam Companies on an "Insect Trap Utilizing A Flexible Containment Means Having An Attractant Therein"; and U.S. Pat. No. 5,401,538 patented Mar. 28, 1995 to R. Perito and assigned to W.R. Grace & Co.-Conn. on "Sprayable Portland Cement-Based Fireproofing Compositions"; and U.S. Pat. No. 5,452,551 patented Sep. 26, 1995 to P. Charland et al and assigned to Minnesota Mining and Manufacturing Company on a "Tiered Firestop Assembly"; and U.S. Pat. No. 5,456,050 patented Oct. 10, 1995 to T. Ward and assigned to Construction Consultants & Contractors, Inc. on a "System To Prevent Spread Of Fire and Smoke Through Wall-Breaching Utility Holes"; and U.S. Pat. No. 5,471,805 patented Dec. 5, 1995 to D. Becker on a "Slip Track Assembly"; and U.S. Pat. No. 5,482,686 patented Jan. 9, 1996 to A. Lebold et at on a "Catalytic Converter"; and U.S. Pat. No. 5,498,080 patented Mar. 12, 1996 to L. Dalea et at and assigned to General Mills, Inc. on an "Easily Expandable, Flexible Paper Popcorn Package"; and U.S. Pat. No. 5,498,466 patented Mar. 12, 1996 to M. Navarro et at and assigned to International Protective Coatings Corp. and Pyro-Tech Industries Inc. on an "Intumescent Composite"; and U.S. Pat. No. 5,508,321 patented Apr. 16, 1996 to K. Brebner on an "Intumescent Silicone Rubber Composition"; and U.S. Pat. No. 5,548,934 patented Aug. 27, 1996 to R. Israelson and assigned to Minnesota Mining and Manufacturing Company on a "Firestop Apparatus For Allowing Pipe Movement"; and U.S. Pat. No. 5,578,671 patented Nov. 26, 1996 to W. Welna and assigned to Minnesota Mining and Manufacturing Company on "Intumescent Putty"; and U.S. Pat. No. 5,634,304 patented Jun. 3, 1997 to M. Sakno on "Water Impervious Intumescent Firestop Collapsing Conduit"; and U.S. Pat. No. 5,656,117 patented Aug. 12, 1997 to E. Wood et al and assigned to Insituform (Netherlands) B.V. on a "Method Of Lining Passageways By Applying A Pre-Liner Sleeve And Hardenable Composition"; and U.S. Pat. No. 5,664,396 patented Sep. 9, 1997 to B. Lyman et al and assigned to MYE, Inc. on a "Vacuum Insulation Panel"; and U.S. Pat. No. 5,702,218 patented Dec. 30, 1997 to D. Onofrio on a "Fastener"; and U.S. Pat. No. 5,744,199 patented Apr. 28, 1998 to E. Joffre et al and assigned to Dow Corning Corporation on a "Method Of Sealing Openings In Structural Components Of Buildings For Controlling The Passage Of Smoke"; and U.S. Pat. No. 5,810,478 patented Sep. 22, 1998 to L. LaFleur and assigned to Custom Packaging Systems, Inc. on a "Bulk Bag With Lift Straps And Exterior Liner"; and U.S. Pat. No. 5,887,395 patented Mar. 30, 1999 to M. Navarro et al and assigned to International Protective Coatings Corp. and Pyro-Tech Industries Inc. on a "Firestop Sleeve"; and U.S. Pat. No. 5,890,245 patented Apr. 6, 1999 to J. Klearman et al and assigned to Therapy Concepts, Inc. on a "Disposable Ventilating Mattress And Method Of Making Same"; and U.S. Pat. No. 5,898,987 patented May 4, 1999 to D. Onofrio on a "Method Of Installing Acoustical Ceiling Grid"; and U.S. Pat. No. 5,921,041 patented Jul. 13, 1999 to J. Egri, II on a "Bottom Track For Wall Assembly"; and U.S. Pat. No. 6,051,193 patented Apr. 18, 2000 to R. Langer et al and assigned to 3M Innovative Properties Company on a "Multilayer Intumescent Sheet"; and U.S. Pat. No. 6,149,304 patented Nov. 21, 2000 to P. Hamilton et al and assigned to The Procter & Gamble Company on a "Flexible Storage Bag With Selectively-Activatible Closure"; and U.S. Pat. No. 6,161,564 patented Dec. 19, 2000 to K. Cornwall on a "Fire Transmission Prevention System"; and U.S. Pat. No. 6,176,053 patented Jan. 23, 2001 to R. St. Germain and assigned to Roger C. A. St. Germain on a "Wall Track Assembly And Method For Installing The Same"; and U.S. Pat. No. 6,189,277 patented Feb. 20, 2001 to J. Boscamp and assigned to Palo Verde Drywall, Inc. on a "Firestop Cavity Occlusion For Metallic Stud Framing"; and U.S. Pat. No. 6,224,835 patented May 1, 2001 to R. Langer and assigned to 3M innovative Properties Company on a "Multilayer Intumescent Sheet"; and U.S. Pat. No. 6,234,408 patented May 22, 2001 to T. Stevens et al on a "Mobile Cementious Fireproofing and Specialty Coating Apparatus"; and U.S. Patent Publication No. 2002/0056242 published May 16, 2002 to A. Andresen on a "Fire Protection Sleeve"; and U.S. Pat. No. 6,406,755 patented Jun. 18, 2002 to L. Kindt et al and assigned to W.R. Grace & Co.-Conn. on a "Sprayable Fireproofing Composition"; and U.S. Pat. No. 6,418,689 patented Jul. 16, 2002 to P. Hacquard et al and assigned to Someta on a "Removable Wall System"; and U.S. Pat. No. 6,458,418 patented Oct. 1, 2002 to R. Langer et al and assigned to 3M Innovative Properties Company on a "Method Of Making Multilayer Sheets For Firestops Or Mounting Mats"; and U.S. Pat. No. 6,572,948 patented Jun. 3, 2003 to M. Dykhoff and assigned to 3M Innovative Properties Company on a "Fire Stop Device With Rupturable Element"; and U.S. Pat. No. 6,698,146 patented Mar. 2, 2004 to M. Morgan et al and assigned to W.R. Grace & Co.-Conn. on "In Situ Molded Thermal Barriers"; and U.S. Pat. No. 6,783,345 patented Aug. 31, 2004 to M. Morgan et al and assigned to W.R. Grace & Co.-Conn. on "In Situ Molded Thermal Barriers"; and U.S.

Pat. No. 6,789,702 patented Sep. 14, 2004 to W. O'Connor et al and assigned to The Gillette Company on a "System For Dispensing Multi-Component Products"; and U.S. Pat. No. 7,043,880 patented May 16, 2006 to M. Morgan et al and assigned to W.R. Grace & Co.-Conn. on "In Situ Molded Thermal Barriers"; and U.S. Pat. No. 7,152,385 patented Dec. 26, 2006 to M. Morgan et al and assigned to W.R. Grace & Co.-Conn. on "In Situ Molded Thermal Barriers"; and U.S. Pat. No. 7,193,152 patented Mar. 20, 2007 to H. Moselle on a "Fire Resistant Barrier"; and U.S. Pat. No. 7,208,677 patented Apr. 24, 2007 to H. Moselle on a "Fire Resistant Barrier"; and U.S. Patent Publication No. 2007/0175140 published August 2, 2007 to K. Giannos on a "Fire Stop System For Wallboard And Metal Fluted Deck Construction"

SUMMARY OF THE INVENTION

The present invention provides a firestop sealing means designed specifically for use with gypsum wallboard for defining wall constructions immediately below head-of-wall construction areas. The construction includes a support leg positioned in abutting relationship with respect to the gypsum wallboard adjacent to and along the edge thereof mounted at the head of wall construction area. A sealing leg is integrally formed with respect to the support leg and extends obliquely angularly outwardly therefrom to a position between the adjacent outer edge of the gypsum wallboard and the head-of-wall construction. The sealing leg will include an intumescent impregnated material therewithin to facilitate firestop sealing thereadjacent. A securement means is included for selectively maintaining abutting engagement between the support leg and the gypsum wallboard adjacent to and along an edge thereof.

There are three main embodiments of the present invention. The first embodiment is shown in FIG. 1 which includes a generally planar support leg with a generally planar sealing leg and is formed of intumescent impregnated paper. Preferably this construction includes a structural layer extending over the intumescent impregnated paper material for providing structural strength thereof. Preferably the layer is a thermoplastic material such as polyethylene but it can be foil scrim which is a prominently used material in this industry. An adhesive layer is positioned on the support leg for selective securement thereof with respect to the gypsum board immediately thereadjacent. The sealing leg extends outwardly from the support leg into an area adjacent to and possibly over the lateral outside edge of the gypsum wallboard. It should be appreciated that the gypsum wallboard can be single layer, double layer or any number of multiple layers which are commonly used in wall constructions in commercial and residential buildings currently. The generally planar upwardly and inwardly extending sealing leg with the intumescent impregnated paper material captured therein by the thermoplastic structural layer will provide a means responsive to the heat of a fire condition for effectively sealing the top-of-wall joint commonly present above gypsum wall constructions.

The detailed construction of the sealing leg can also comprise a generally P-shaped member which includes an arcuate sealing section as shown best in FIGS. 2 and 3. With this configuration the member preferably can be made from an extruded intumescent impregnated thermoplastic material and the loop provides a flexible resilience for facilitating firestop sealing in the head-of-wall thereadjacent.

Another alternative configuration as shown in FIGS. 4 and 5 is an A-shaped design which includes two separate support leg sections, one extending vertically on both sides of the edge of the gypsum wallboard with a channel defined therewithin for capturing and frictionally gripping the wallboard to provide the means for securement with respect thereto. This generally A-shaped profile includes a cross member which extends over the butt end of the gypsum wallboard construction with the sealing member extending upwardly therefrom and being arcuate. Both the P-shaped profile and the A-shaped profile can preferably be formed as extrusions utilizing thermoplastic material impregnated with an intumescent component.

It is an object of the planar sealing means for gypsum wallboard of the present invention to provide a system which minimizes cost.

It is an object of the planar sealing means for gypsum wallboard of the present invention to provide a less labor intensive means for achieving full sealing of the edges wallboard than is currently being used particularly in the open zone area beneath the floor construction thereabove and to provide a planar sealing gasket which is attachable to the edge of the wallboard such that the surrounding sealing means is automatically placed simultaneously whenever the gypsum wallboard itself is placed in position.

It is an object of the planar sealing means for gypsum wallboard of the present invention to provide a system which is easily maintained.

It is an object of the planar sealing means for gypsum wallboard of the present invention to provide a system which can be attached to one side of the gypsum wallboard prior to installation such that the gypsum wallboard and the firestopping means are positioned simultaneously.

It is an object of the planar sealing means for gypsum wallboard of the present invention to provide a system which is flexibly resilient to allow for relative movement between the wallboard and the top-of-the-wall construction immediately thereadjacent beneath a floor thereabove.

It is an object of the planar sealing means for gypsum wallboard of the present invention to provide a system which can be made of intumescent paper material.

It is an object of the planar sealing means for gypsum wallboard of the present invention to provide a system which will include a structural layer preferably of polyethylene or foil-scrim.

It is an object of the planar sealing means for gypsum wallboard of the present invention to provide a system which can include an adhesive layer which may comprise pressure sensitive adhesive tape.

It is an object of the planar sealing means for gypsum wallboard of the present invention to provide a system which can be made available in extended long lengths which can be cut to shape as needed.

It is an object of the planar sealing means for gypsum wallboard of the present invention to provide a system which can be supplied in extended lengths such that it can be coiled to facilitate providing thereof for being cut into whatever lengths are needed for the particular job.

It is an object of the planar sealing means for gypsum wallboard of the present invention to provide a system which is capable of following the contours of a top-of-the-wall length positioned thereadjacent.

It is an object of the sealing means for gypsum wallboard disclosed in the present invention to provide a system which can be made with an intumescent extruded rubber profile which can attach to only one side of the gypsum wallboard.

It is an object of the sealing means for gypsum wallboard disclosed in the present invention to provide a system which can be made with an intumescent extruded rubber profile which can attach simultaneously to both sides of the gypsum wallboard.

It is an object of the sealing means for gypsum wallboard disclosed in the present invention to provide a system which can be made with an intumescent extruded rubber profile which can be attached to the gypsum wallboard prior to securement thereof to the head-of-wall joint area.

It is an object of the sealing means for gypsum wallboard disclosed in the present invention to provide an extruded profile in the shape of an "A" or a "P" which can be adhered to the top edge of the system wallboard prior to placing thereof.

It is an object of the sealing means for gypsum wallboard disclosed in the present invention to provide a sealing gasket that includes a flexible upper rounded section which can be compressed in adjacent with a lower surface of a floor thereabove simultaneously with positioning of the system wallboard in place for attachment to the wall area therebelow.

It is an object of the sealing means for gypsum wallboard disclosed in the present invention to provide a system which can be used with various configurations of building construction including being capable of following the contours of a steel fluted deck floor or roof system.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
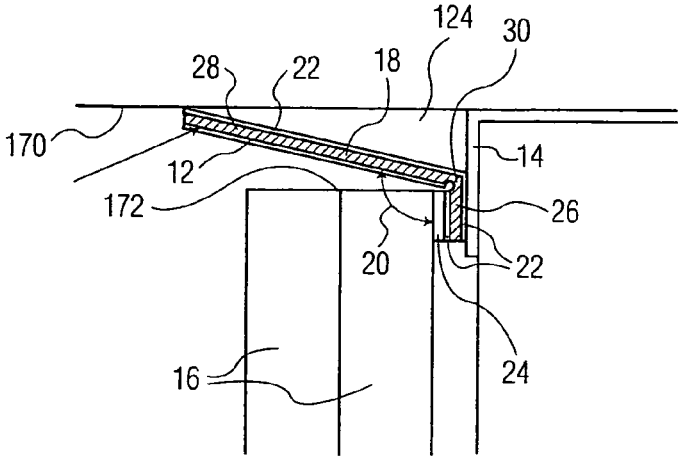
FIG. 1 shows a cross-sectional view of an embodiment of the firestopping sealing means of the present invention shown in position sealing a top-of-the-wall joint utilizing a planar firestopping sealing means extending upwardly and inwardly from the support leg extending over the end edge of gypsum wallboard positioned extending into the adjacent head-of wall joint for firestopping sealing thereof.

The present invention provides a sealing means in the form of a firestopping gasket 12 which is attachable to the edges, preferably the top edges, of gypsum wallboard layers 16 normally positioned often adjacent to steel studs present in such construction. A steel track 14 is shown positioned thereadjacent.

The firestopping gasket 12 will preferably include two sections including a support or mounting leg 26 and a sealing leg 28 attached thereto and preferably formed integrally therewith and extending outwardly therefrom. In the configuration shown in FIG. 1 the support leg 26 and the sealing leg 28 are at oriented at an obtuse angle 20 with respect to one another of slightly greater than 90 degrees.

The construction of the gasket 12 itself includes a base layer of material having an intumescent component such as intumescent impregnated paper 18 in the FIG. 1 embodiment. This material includes a structural layer 22 extending thereover, preferably positioned over both sides thereof which provided added structural strength and rigidity and is more aesthetically pleasing. This structural layer, preferably, is of a thermoplastic material such as polyethylene but it can also be formed of foil scrim commonly used for various purposes in the firestopping industry. The structural layer 22 provides structural integrity to the planar shape of the gasket 12 as shown best in FIG. 1. In particular, the combination of the structural layer 22 and the intumescent impregnated paper 18 provides a combined strength and resiliency to the overall structure of the gasket 12 such that it can maintain shape and impart an element of flexible resilience thereto such that, as shown in FIG. 1, when positioned between the gypsum board layers 16 and the steel track 14, the sealing leg 28 which extends outwardly from the support leg 26 will maintain an obtuse angle 20 to effectively abut with the concrete slab 10 of the upper floor positioned thereabove for firestop sealing thereadjacent. The intumescent paper 18 is flexible such that the added structural layer provides resilient and structural strength thereto. The structural layer 22 is preferably of a thermoplastic material such as polyethylene or other similar material in order to help to maintain the physical orientation between the sealing leg 28 and the support leg 26 as necessary.

One of the important advantages of use of the firestopping gasket 12 of the present invention is in the ease of installation. This advantage is provided by the inclusion of an adhesive layer 24 which can be formed of pressure sensitive adhesive tape or any other common adhesive material such that the sealing leg 28 can be attached easily and quickly to the edge of the gypsum board 16 prior to attachment to the wall at the worksite. Therefore, when the gypsum board layers 16 are secured to the wall the firestopping gasket 12 will be also secured in place with the support leg 26 thereof positioned between the steel track 14 of the wall and the gypsum board layer 16 for securement thereof in place without requiring any special separate labor activity. Normally these areas are sealed by mastic materials such as caulking or the like which requires a separate labor step after mounting the gypsum board which requires additional time and expense because of the labor and materials involved. The present invention achieves the placement of a sealing means between the upper edge of the gypsum board layer 16 and the concrete slab 10 thereadjacent in the top-of-the-wall joint area without any separate step because of the initial placement of the gypsum board layer 16 in the proper location with the gasket of the present invention secured along the edge thereof.

One of the most important aspects of the present invention is the flexibly resilience that is imparted to the firestopping gasket 12 by using a two component material including a layer of intumescent paper 18 and the structural layer 22 of polyethylene or foil-scrim or other similar material. This combined structure provides the intumescent characteristic readily apparent from the intumescent component of paper 18 and it also provides the structural strength and flexible resilience required such that the sealing leg 28 of the FIG. 1 embodiment extends outwardly and upwardly from the upper edge of the gypsum board layer 16 into abutment with respect to the concrete slab thereabove. This double layered construction will help maintain the preset shape of the gasket due to the flexible resilience thereof which maintains forcible abutment of the intumescent sealing portion with respect to the lower surface of the concrete slab 10. In this manner the top-of-the-wall sealing defined below the concrete slab 10 will be maintained sealed at all times despite relative movement between the top-of-the-wall joint and the gypsum board layer 16 commonly experienced in such joints because the sealing leg 28 will flex to accommodate any movement in the relative position due to the flexible resilience in the structure thereof.

Preferably the gasket member of the present invention is provided in extended length and can be coiled to facilitate transport thereof. The providing of this material in such extended lengths will allow the installation personnel to cut the flexibly resilient gasket as needed in sections for fully sealing the open joint area between the top of the gypsum wallboard 18 and the bottom of the floor assembly 122. Also it is preferably that a longitudinally extending cut or slot 30 is defined in the structural layer 22 at the intersection between the sealing leg 28 and the support leg 26. This slot 30 will facilitate bending of the sealing leg 28 to the desired oblique angle relative to the support leg 26. This slot 30 can be manufactured in the original sealing means as manufactured or can be formed in the field by scoring along the intersection between the sealing leg 28 and the support leg 26.

As shown in the embodiments shown in FIGS. 2-5 the use of the sealing means 112 formed as an extruded sealing member 114 is particularly usable with steel fluted deck floor systems. With such a fluted shape in the deck floor the extruded sealing member 114 can be cut to various lengths as needed to provide a full firestopping seal in all areas of the open joint area 124.

Figure 2:
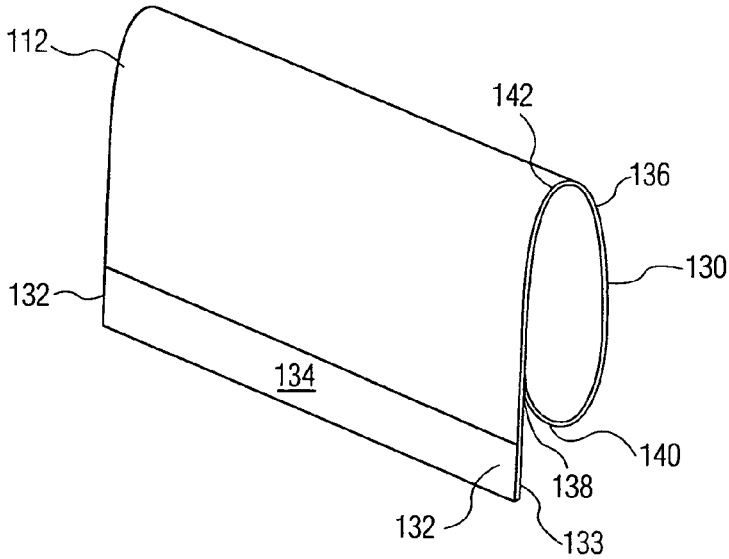
FIG. 2 is a perspective illustration of an embodiment of the sealing leg means of the present invention utilizing a "P-shaped" profile.
Figure 3:
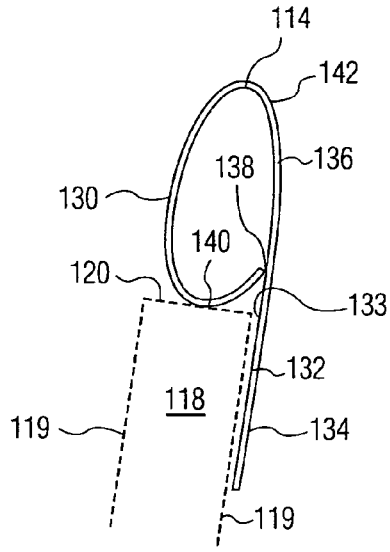
FIG. 3 is an end plan view of the construction of the profile shown in FIG. 2.
Figure 4:
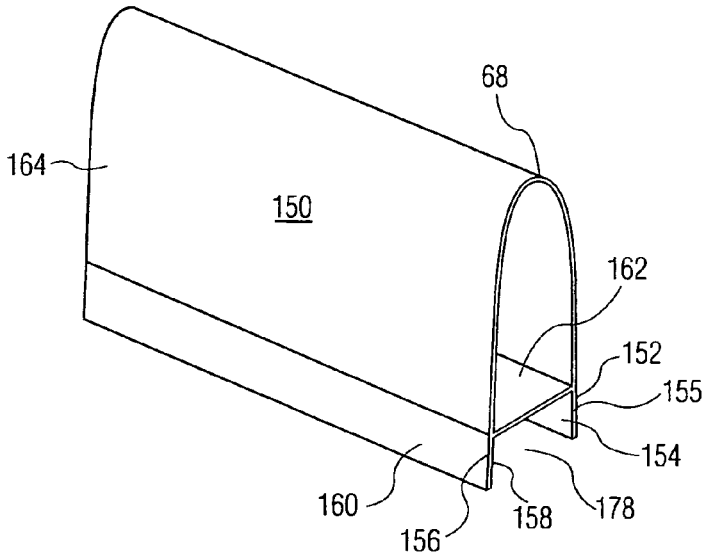
FIG. 4 is a perspective illustration of an embodiment of the sealing means of the present invention shown having an "A-shaped" profile.
Figure 5:
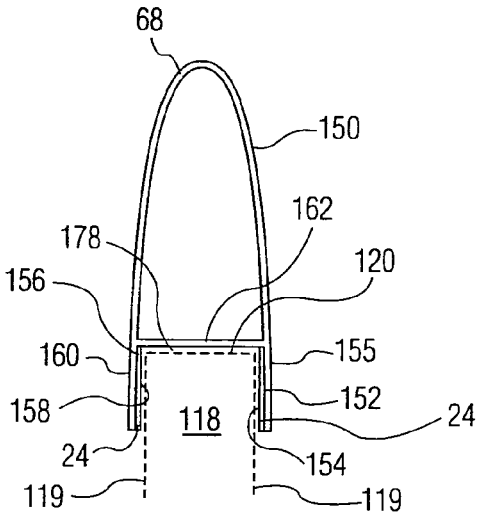
FIG. 5 is an end plan view of the profile of the sealing means shown in FIG. 4.

With the present invention the sealing gasket can be formed conveniently as extruded shaped formed from thermoplastic materials. Two preferred shapes for the thermoplastic extrusion have been found to be useful for this purpose. FIGS. 2 and 3 show the P-shaped profile 130 whereas FIGS. 4 and 5 show the A-shaped profile 150.

The P-shaped profile 30 for the extruded sealing member 114 is formed with a leg section 132 and a rounded section 136 positioned upwardly with respect thereto. The overall construction is actually formed by a singular linear panel which extends from the bottommost portion of leg section 132 upwardly through the rounded section 136 such that it then extends through the area of rounded section 136 with the end of rounded section 138 in abutment with the inner leg surface 133 and the leg section 132 at an intermediate position therealong. The P-shaped profile extrusion also defines an outer leg surface 134.

The leg section 132 provides the means for adherence between the wallboard paper facing 119 which is included along the outermost surfaces of the gypsum wallboard 118 and the extrusion 114. The inner leg surface 133 is positioned in abutment with respect to the gypsum wallboard 118 and can be secured thereto in any conventional manner such as by an adhesive or by threaded fasteners or integral barbs or any other conventional means. Normally a mastic connection will be utilized. In this manner the user can easily secure the inner leg surface 133 of the leg section 132 of the P-profile 130 of the extrusion 114 with respect to the gypsum wallboard 118 prior to positioning and attachment thereof with respect to an adjacent building structure.

The rounded section 136 of the P-shaped profile 30 will include a lower facing rounded section 140 thus positioned in abutment with respect to the gypsum board upper edge 120. The rounded section 136 will also include an upper surface 142 thereof which is designed to be brought into abutment with respect to the bottom of the floor assembly 122. As such, when the gypsum wallboard 118 is placed in abutment with respect to the mounting members to which it is designed to be secured to form a structural wall, the worker will exert an upward force on the gypsum wallboard which urges the upper surface 142 of the rounded section to be forcibly engaged against the bottom of the floor assembly 122. Preferably the material from which the extruded sealing member 114 is made will be a flexibly resilient material such as preferably including a thermoplastic material component such that it will slightly deform and create a resilient bias in firestop sealing between the gypsum wallboard upper edge 120 and the bottom of the floor assembly 122. Thus the rounded section 138 will achieve an effective firestopping seal of the open head-of-wall joint area 124 between the top of the gypsum wallboard and the bottom of the floor assembly immediately. Preferably the extruded material from which the sealing member 114 is made will include an intumescent or other firestopping component for enhancing the firestop sealing of this open joint area 124 when subjected to the heat of a fire.

Another alternative configuration of the profile is shown in FIGS. 4 and 5 wherein the profile is approximately A-shaped. With this A-profile an arcuate upper section 164 will be provided closed at the bottom portion by a generally horizontally extending cross member 162. The combination of the arcuate upper section 164 and the cross member 162 will provide an overall closed section when viewed in side profile as shown best in FIG. 5.

The A-shaped is defined by the inclusion of a first leg section 152 extending downwardly from the cross member 162. A second leg section 156 will also extend downwardly from the cross member 162 at a position spatially disposed from the first leg section 152. In this manner a mounting channel 178 will be defined between the first leg section 152 and the second leg section 156 adapted to receive the gypsum wallboard 118 positioned therebetween.

In particular, the first leg section 152 will include a first inner leg surface 154 and a first outer leg surface 155. The first inner leg surface 154 will be adapted to be positioned in abutment with respect to the wallboard paper facing 119 on one side of the gypsum wallboard 118. The second leg section 156 will include a second inner leg surface 158 and a second outer leg surface 160. The second inner leg surface 158 will be positioned adjacent to the opposite wallboard paper facing 119 of the gypsum wallboard 118. In this manner the first inner leg surface 154 and the second inner leg surface 158 will grasp therebetween the gypsum wallboard 118 to facilitate securement therewith. In this manner, if the lateral spacing between the first inner leg surface 154 and the second inner leg surface 158 is small enough, a wedged or snug friction gripping will occur of the gypsum wallboard 118 and the wallboard paper facings 119 on each opposite side thereof. As such, when using the A-shaped profile 150 for the extruded sealing member 114 in some applications no separate means of securement or adhesion between the extruded member 114 and the gypsum wallboard 118 will be required. That is, in some configurations the spacing will be small enough that a friction gripping of the gypsum wallboard 118 between the legs of the A-shaped profile 150 will be sufficient for securement therebetween. Alternatively, if needed, additional securement means may be included such as adhesives or glues or separate physical fastening means such as screws or nails which can protrude through both the legs and the wallboard can be used.

As such, these two different designs show additional examples of shapes of the extruded sealing members 114 of the present invention can be utilized to form a full seal in the head-of-wall area between the floor 170 and the wall 172 immediately positioned therebelow. When a gypsum wallboard 118 is placed in position the flexibly resilient material of the extruded sealing member 114 will be compressed such that the upper facing arcuate section 68 of the arcuate upper section 164 of the A-shaped profile 150 will be urged into abutting engagement with respect to the bottom of the floor assembly 122 for efficiently creating a firestopping sealing therebetween.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A firestopping sealing means for use with gypsum wallboard in a head-of-wall construction comprising:

A. a support leg being generally planar in shape and being positioned in abutting engagement with respect to a gypsum wallboard adjacent to and along an upper edge thereof mounted adjacent to a head-of-wall construction area;

B. a sealing leg being generally planar in shape and integrally formed with respect to said support leg and extending obliquely angularly outwardly therefrom to a position directly vertically above the adjacent end of the gypsum wallboard between the upper outside edge of the gypsum wallboard and the head-of-wall construction thereabove, said sealing leg being formed of intumescent impregnated paper material to facilitate firestopping thereadjacent; and C. a securement means for selectively maintaining abutting engagement between said support leg and the gypsum wallboard adjacent to and along an edge thereof.

2. A firestopping sealing means for use with gypsum wallboard in a head-of-wall construction as defined in claim 1 wherein said sealing leg further includes a structural layer extending structurally over said intumescent impregnated paper material.

3. A firestopping sealing means for use with gypsum wallboard in a head-of-wall construction as defined in claim 2 wherein said support leg includes a front surface positioned facing the gypsum wallboard thereadjacent for attachment thereof and a rear surface facing oppositely therefrom, and wherein said structural layer extends completely across said front surface and said rear surface of said intumescent impregnated paper material of said sealing leg for structural strengthening thereof.

4. A firestopping sealing means for use with gypsum wallboard in a head-of-wall construction as defined in claim 2 wherein said structural layer is formed of a thermoplastic material.

5. A firestopping sealing means for use with gypsum wallboard in a head-of-wall construction as defined in claim 4 wherein said structural layer is formed of polyethylene.

6. A firestopping sealing means for use with gypsum wallboard in a head-of-wall construction as defined in claim 2 wherein said structural layer is formed of foil scrim.

7. A firestopping sealing means for use with gypsum wallboard in a head-of-wall construction as defined in claim 1 wherein said securement means comprises an adhesive layer positioned on said support leg immediately adjacent the gypsum wallboard to facilitate attachment between said support leg and the adjacent gypsum wallboard.

8. A firestopping sealing means for use with gypsum wallboard in a head-of-wall construction as defined in claim 1 wherein said securement means comprises pressure-sensitive adhesive tape attached to said support leg immediately adjacent the gypsum wallboard to facilitate attachment between said support leg and the adjacent gypsum wallboard.

9. A firestopping sealing means for use with gypsum wallboard in a head-of-wall construction as defined in claim 3 wherein said structural layer extending over said front surface of said support leg defines a longitudinal cut therein extending longitudinally along said front surface at the interface between said support leg and said sealing leg to facilitate orientation of said sealing leg at an oblique angle with respect to said support leg extending over the adjacent edge of the wallboard thereadjacent.

10. A firestopping sealing means for use with gypsum wallboard in a head-of-wall construction as defined in claim 1 wherein said sealing leg is obliquely angularly oriented with respect to said support leg at an angle of between 91 degrees and 135 degrees to effectively firestop the head-of-wall joint thereadjacent.

11. A firestopping sealing means for use with gypsum wallboard in a head-of-wall construction as defined in claim 1 wherein said sealing leg extends completely across the upper end of the gypsum wallboard.

12. A firestopping sealing means for use with gypsum wallboard in a head-of-wall construction as defined in claim 1 wherein said sealing leg extends completely across above and beyond the upper end of the gypsum wallboard to a position vertically above and beyond the gypsum board side opposite from the gypsum board side in abutment with said support leg.

* * * * *